US008782965B2

(12) United States Patent
Hava

(10) Patent No.: US 8,782,965 B2
(45) Date of Patent: Jul. 22, 2014

(54) UNIVERSAL HUB AND STRUT SYSTEM FOR A GEODESIC ENCLOSURE

(76) Inventor: Heather Marie Hava, Golden, CO (US)

( * ) Notice: Subject to any disclaimer, the term of this patent is extended or adjusted under 35 U.S.C. 154(b) by 0 days.

(21) Appl. No.: 13/374,194

(22) Filed: Dec. 15, 2011

(65) Prior Publication Data

US 2013/0152486 A1 Jun. 20, 2013

(51) Int. Cl.
*E04B 7/08* (2006.01)

(52) U.S. Cl.
USPC ..... 52/81.3; 52/653.1

(58) Field of Classification Search
CPC ..... E04B 2001/3294; E04B 2001/3247; E04B 2001/1915; E04B 2001/1918; E04B 2001/1921; E04B 2001/193; E04B 2001/1927; E04B 2001/1957; E04B 2001/1963; E04B 2001/2406; E04B 2001/2415; E04B 1/19; E04B 1/1903; E04B 1/1906; E04B 1/1909; E04B 1/1912; E04B 1/21; E04B 1/215; E04B 1/24; E04B 7/10; E04B 7/102; E04B 7/105; F16B 7/044; A63B 2009/006; Y10S 52/10; E04C 5/0636; E04C 2/40
USPC ..... 52/80.1, 81.1, 81.2, 81.3, 650.2, 653.1, 52/648.1, 638, 645, 646; 403/170, 172, 403/171, 174, 176, 217, 218, 219
See application file for complete search history.

(56) References Cited

U.S. PATENT DOCUMENTS

| | | | | |
|---|---|---|---|---|
| 4,131,380 | A * | 12/1978 | De Bliquy | 403/217 |
| 4,511,278 | A * | 4/1985 | Robinson | 403/172 |
| 4,521,998 | A * | 6/1985 | DeLorme | 52/81.3 |
| 4,592,671 | A * | 6/1986 | Daum | 403/171 |
| 7,481,235 | B2 * | 1/2009 | Prusmack | 135/135 |
| 2006/0291952 | A1 * | 12/2006 | Wood | 403/217 |

* cited by examiner

*Primary Examiner* — Jessica Laux

(57) ABSTRACT

An improved universal hub and strut system for a geodesic enclosure framework is disclosed. The universal hub and strut system disclosed herein allows a geodesic structure to be more quickly assembled and with increased integrity. The geodesic structure is assembled by interconnecting a plurality of universal hubs and struts at each vertex of a geodesic spatial framework. To connect a strut to a universal hub of the present system, a strut-tab on a strut end overlaps a hub-tab of the universal hub, which is secured together via a fastening means through the respective ports. Based on the flexibility of the hub-tabs, the geodesic structure design disclosed herein may depart from the geometric designs associated with traditional geodesic structures. The invention may be applied in any geodesic type dome, structure, or enclosure.

14 Claims, 11 Drawing Sheets

UNIVERSAL HUB AND STRUT SYSTEM FOR A GEODESIC ENCLOSURE

TECHNICAL FIELD

The invention relates generally to geodesic enclosures, and more particularly to improved structural components for quicker and easier assembly of such enclosures and structures.

BACKGROUND

Geodesic enclosures are partially spherical lattice shell structures constructed of interlocking polygons. The completed shell structure of a geodesic enclosure can be covered externally or internally (or both) to create a partially spherical enclosure. Although originally used in architecture by the German engineer Walter Bauersfeld, Buckminster Fuller provided the mathematics, modern research and writings to promote and popularize the geodesic enclosure as an enclosure for humans. There are numerous uses for geodesic enclosures such as habitations for extreme environments; temporary enclosures during research, disaster, or humanitarian relief; as storage units for large objects; and, for events requiring an enclosed structure with a large volume capacity. It is well known in the art that geodesic enclosures can also provide notable stiffness and rigidity without the need for internal structural supports when the structure is assembled. Assembly of a geodesic enclosure can quickly become complex when dome components are not easily interchangeable as well as require different angles and multiple configurations. These difficulties can make assembly of a geodesic enclosure resource and time intensive.

The first known geodesic enclosure structure used in architecture was completed in 1923. Engineer Walther Bauersfeld first used the dome design for the planetarium in Jena, Germany to test his projector invention. Bauersfeld conceived of the dome so that he could display his recreation of the stars at the planetarium via his projector. For the projector of the stars to properly display the night sky, Bauerseld required a hemispheric dome. Bauersfeld improved his geodesic design over time, but the geodesic enclosure as a functional design for habitation and more was virtually ignored until Buckminster Fuller began publishing his materials.

A geodesic enclosure can provide the infrastructure for a habitat designed for isolated areas of the world, space exploration purposes, and for a myriad of other uses. Spherical designs provide the most volume within an enclosure while requiring the least surface area. Because geodesic enclosures have a high strength-to-weight ratio they may be a preferable habitation or storage structure for areas having harsh environmental conditions such as Antarctica, the ocean, space, or desert regions. In earthquake prone areas, the low center of gravity attributable to the geodesic enclosure design makes them more resistant to the effects of earthquakes than enclosures with a higher center of gravity. The U.S. military has already experimented with—as well as implemented—modular and portable geodesic enclosures for geographically isolated areas of the world for research and intelligence purposes.

One method of geodesic enclosure construction utilizes a series of hubs and struts that interconnect into a series of polygons to create the frame of a spherical structure, an aspherical structure, or any portion thereof. The number of hubs and struts needed for a geodesic enclosure as well as the angles that they would need to be placed at differ based on the size and frequency of the intended structure. The strut lengths also vary based on the desired size and frequency of a geodesic enclosure. However, larger geodesic enclosure structures require a higher frequency, which results in improved structural strength and stability compared to that of lower frequency domes.

Although geodesic enclosure designs are considered promising as a matter of architecture and habitation, there are design areas in which they can be noticeably improved upon. The strut ends in some current geodesic enclosure designs are often crimped so that they can be attached to a bolt, rivet, or other connecting means, reducing the overall strength of the strut. One problem with this prior art design is that the struts used to provide the frame currently offer minimal strength when connected at corresponding vertices in geodesic enclosure structures.

Moreover, different sizes and different frequencies of geodesic enclosures also require specific hubs and strut lengths to be precisely manufactured, which further increases manufacturing costs. Based on the frequency and size of the geodesic enclosure structure intended, specific hubs must be manufactured to conform to the various angles that the frequency requires. Struts for geodesic enclosures in the prior art are often cut as a matter of practice to their desired lengths, the ends are crimped and then a hole is drilled into the crimped end; a single bolt then secures the struts at a vertex. Crimping the strut component weakens its integrity and structural strength hence reducing the total load bearing capability of the dome. It would be advantageous if crimping of a strut could be eliminated and a modular approach applied to the manufacturing of structural components. There does not appear to be a universal hub and strut apparatus that exists that can be applied to all geodesic enclosure sizes and frequencies. It would be beneficial to have a modular dome assembly system with easily customizable hubs that could be quickly adapted to any geodesic enclosure size and frequency.

U.S. Pat. No. 4,357,118 to Murray discloses a hexagonal shaped connecting assembly for a geodesic enclosure. The connecting hub disclosed by Murray includes a plurality of U-shaped connecting members and U-shaped ports along the edges of the hexagonal shaped connecting assembly hub. The components are then connected via a bracket that is secured to both the hub and the strut. There are several limitations to this device compared to the present invention; for example, the device to Murray is not an assembly that would be universally compatible with multiple dome frequencies, which is important for reducing manufacturing and assembling costs for geodesic enclosure structures.

U.S. Pat. No. 4,262,461 to Johnson & Johnson discloses a geodesic enclosure connector. The connector interconnects the dome struts via a plurality of circumferentially spaced openings with a plurality of metal tongues that secure to the strut ends used for the dome. The strut ends connect into the spaced openings along the connector through one or more tapered pins used to secure the components.

U.S. Pat. No. 4,370,073 to Ohme discloses a connector hub for geodesic enclosure structures similar to the device claimed by Murray. As struts converge to the U-shaped connection points on the connector hub, the struts attach via hinge plates and connectors at the edges of each strut. The Ohme patent provides for an integrally cast connector hub with radially extending stringer receiving slots for struts used to assemble the dome structure. However, the Ohme hub fails to be universally applicable to all geodesic enclosure sizes and frequencies, which increases the manufacturing costs of dome structures using this hub design compared to that of the invention disclosed in the present application.

U.S. Pat. No. 4,844,649 to Vandenboom discloses a bracket assembly to interconnect support struts to create a dome structure. The apparatus claimed by Vandenboom allows for an adjustable way to connect struts in a geodesic enclosure design via an improved hub having bracket members that secure the struts to the claimed hub. However, the adjustability of the struts is a weakness in the Vandenboom patent that makes the Vandenboom dome structure less capable of bearing weight and pressure compared to similar structures built using the invention claimed herein.

U.S. Pat. No. 4,521,998 to DeLorme also discloses a hub connector for a geodesic enclosure. As struts converge, the struts attach via hinge plates and connectors at the edges of each strut. The advantage to the patent to DeLorme over the prior art is that the struts can be arranged in a number of combinations to create geodesic enclosures with unique triangle patterns, converging angles, articulating angles, and chord or strut lengths. However, the invention does not provide a universal system applicable to any frequency geodesic enclosure that also improves the strength of the assembled dome structure compared to that of the present invention.

U.S. Patent Application US/2006/0291952 to Wood describes a structural member connector for connecting a plurality of struts to one or more hubs on a geodesic enclosure or other design. An advantage to Wood's hub device is that the corresponding struts do not have to be flattened to attach to the strut. Although Wood's hub eliminates the need to flatten strut members, multiple hub configurations must still be designed based on the size and frequency of the dome.

U.S. Patent Application US/2009/0056239 to Wolfram discloses a hexagonal shaped connector for geodesic enclosure structures wherein each hexagonal edge includes strut portions that allow the actual strut component to be fastened to the connector. However, the struts used in the application to Wolfram still do not overcome the inherent weakness in certain geodesic enclosure strut designs caused by crimped or tapered weaker strut edges and a stronger strut mid-section.

Therefore, there is a need for an improved hub and strut system that provides a universal hub assembly that reduces manufacturing costs, improves the strength of geodesic enclosures, and simplifies assembly thereof for various sizes and frequencies. The present invention accomplishes these objectives.

SUMMARY

One embodiment of the present invention provides a universal hub and strut system for a geodesic enclosure that decreases manufacturing costs, reduces assembly times, and increases the rigidity and strength of the geodesic structure over current geodesic enclosure designs.

As will be discussed in more detail, the focus of the present invention is to provide a universal hub and strut system for geodesic enclosure construction. The hub and strut system discussed herein can be applied to any geodesic enclosure frequency and size. The hub and strut system disclosed herein also increases the structural strength of the geodesic enclosure, which improves the utility of the geodesic enclosure for all applications.

One goal of the present invention is to provide a universal hub and strut system that can be applicable to any geodesic enclosure or spherical structure of any frequency and size. Another goal of the present invention is to provide a universal hub and strut system to make assembly of a geodesic structure more efficient. It is another goal of the present invention to provide a geodesic enclosure that has improved structural integrity.

BRIEF DESCRIPTION OF THE DRAWINGS

The aforementioned and other features and objects of the present invention and the manner of attaining them will become more apparent and the invention itself will be best understood by reference to the following descriptions of a preferred embodiment and other embodiments taken in conjunction with the accompanying drawings, wherein.

DETAILED DESCRIPTION

Figure 1:
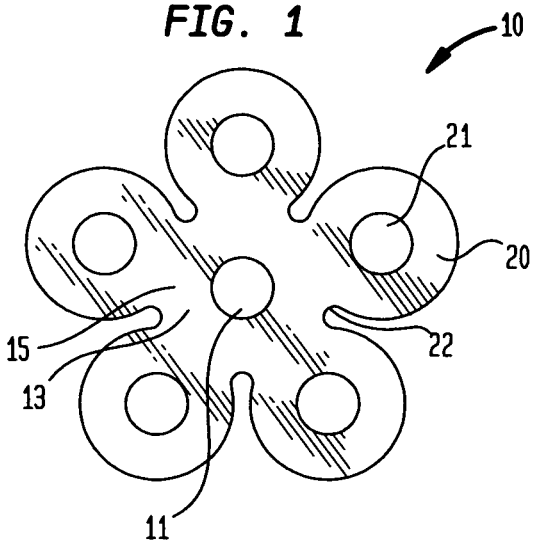
FIG. 1 illustrates a top plan view of an exemplary embodiment of an unformed pentagonal universal hub.

Referring now to the drawings, exemplary embodiments of the invention are described below in the accompanying Figures. The following detailed description provides a comprehensive review of the drawings in order to provide a thorough understanding of, and an enabling description for, these embodiments. One having ordinary skill in the art will understand that the invention may be practiced without certain details. In other instances, well-known structures and functions have not been shown or described in detail to avoid unnecessarily obscuring the description of the embodiments.

When referring to the term "geodesic enclosure" in this patent application, the definition is intended to include any and all types and dimensions of geodesic domes that rely on polyhedral construction, to include spherical and aspherical structures, or any portion thereof. When referring to the terms "interior" or "exterior" in this patent application, the definition is intended to refer to the interior or exterior side of the assembled structure, respectively. When referring to the term "spherical" herein, the definition is intended to include all curved shapes whether they are portions of true spheres, spheroids, ovoids, convex surfaces, concave surfaces, etc.

When constructing a geodesic enclosure structure, different numbers of hubs and struts are required to scale the geodesic enclosure to the desired size and frequency. Moreover, hubs must be angled to conform to the dimensional requirements of a specific dome frequency. Struts may also differ in length based on the size and frequency required for the geodesic structure. As the size of a geodesic enclosure increases, the frequency of the dome generally increases as well to maintain structural stability and strength. While a one-frequency enclosure will only require a single strut length, a dome with a frequency of two or more will require struts of additional lengths to assemble the geodesic enclosure. The strut-tabs disclosed in the present invention can be attached to each end of a shaft of any length, which eliminates the problem of having to construct various designs for struts.

To replicate an icosahedron geodesic structure of any frequency, at least three different types of intersections are needed for the struts. The intersection pieces required to assemble a geodesic enclosure structure include a plurality of pentagonal, hexagonal, and irregular pentagonal intersections or hubs. The invention described herein allows a geodesic enclosure to be assembled of any size and frequency using only three variations of the disclosed universal hub design. To assemble a geodesic enclosure of any size and frequency, a plurality of pentagonal, hexagonal, and irregular pentagonal hubs interconnect with a plurality of struts. The details for practicing the universal hub and strut system for a geodesic enclosure are described herein.

The universal hub is the junction point to connect the struts used to construct the geodesic enclosure framework. The universal hub with hub-tabs contemplated in the present invention resembles a "flower with petals," the petals corresponding to the hub-tabs and the pistil corresponding to the polygonal center component. Additionally, the number of hub-tabs correlates to the number of edges present on the center component. The three universal hub designs necessary to build a geodesic enclosure using the polygonal universal hub and strut system are a simple hexagon for the hexagonal hub, a simple pentagon for the pentagonal hub, and an irregular pentagon that includes a mounting-tab to secure the enclosure to a foundation, flooring, or other structure.

Each universal hub has several hub-tabs that can be formed along the edges of the hub center component to the angle required by the dome frequency. Semi-spherical embodiments of the universal hub in the formed configuration follow a contour when constructing the desired frequency. Each hub-tab along each edge of a polygonal hub can be formed individually for design requirements or as needed. The hub tabs on the hexagonal and pentagonal hubs may be formed at an angle of negative one hundred and eighty degrees to one hundred and eighty degrees inclusive in relation to a plane perpendicular to the central axis of the center port of the center component. The mounting hub-tab on the mounting hub is unique compared to the other hub-tabs in that it may be formed at an angle of zero degrees to one hundred and eighty degrees in relation to a plane perpendicular to the central axis of the center port of the center component, to assist with securing the enclosure to a foundation or other structure. This hub tab and hub itself can be reinforced or otherwise built heavier, stronger, thicker, etc. to allow it to bear significantly more forces than the standard hubs. Based on the requirements of the geodesic enclosure, an individual universal hub will receive two or more struts that meet at the universal hub creating a vertex joint. Each end of a strut attaches to a corresponding hub and connects via a fastening means which, when all struts and hubs are connected, creates a geodesic enclosure. Each strut can attach to either the exterior or the interior face of a hub tab.

For construction materials, any number of metals or solid materials can be used to construct or build the universal hub component including steel, aluminum, titanium, other alloys, polymers, composites, or other suitable materials.

Although the angles at which the hub-tabs extend from the universal hub will differ based on the geodesic enclosure size and frequency. The present invention allows the hub-tabs of a universal hub to be easily formed so as to conform to specific size and frequency requirements. Based on the specific frequency required by the geodesic enclosure being built, the hub-tabs of the universal hub can be formed at an angular range of anywhere between negative one hundred and eighty degrees to one hundred and eighty degrees in order to create the geodesic enclosure. The universal hub disclosed herein is designed so that the angles of hub-tabs can be appropriately formed after the desired frequency is determined, which may reduce the overall component manufacturing costs.

As an alternative to a polygonal type hub design, the hub-tabs can also be placed along the perimeter of a concave, convex, spherical or semi-spherical shaped center component of the universal hub. Instead of the hub-tabs being arranged along the edges of the polygon, the hub-tabs of the hub can be similarly arranged like the polygonal hub disclosed herein but with a spherical design with a hexagonal, regular pentagonal, or irregular pentagonal hub around the exterior perimeter of the hub center component. It is contemplated that a universal spherical hub and strut system would also accomplish the goals of the present invention.

Another unique element provided by the universal hub system is the port located in the center of each hub center component. The center port on the universal hub component may be used to receive additional internal or external structural connections. With a port placed centrally in each universal hub, a supporting floor structure, equipment, instruments, cables, piping and/or other components can be attached or added to the geodesic enclosure. One or more hub caps may be attached at the center port on the exterior or interior face of the hub (or both) to act as a spacer between the hub and other components of the structure such as an external covering or internal façade/covering. It is significant that the current design provides the ability to attach an external cover, an internal cover, or both to the hub. Once assembled, the central ports within the universal hubs in a geodesic enclosure may also be used to fasten supporting components along the outside (or inside) of the geodesic enclosure that further increase the structural strength of the geodesic enclosure.

The strut-like members for certain previous geodesic enclosure designs have been comprised of materials such as pipe or tubing that can be later crimped to receive a bolt, screw, or other fastener. Crimping the ends of a strut cylinder weakens the strength of the strut when interconnected in a geodesic enclosure. Unlike crimped strut designs in the prior art, the invention disclosed herein does not require crimping, which increases the strength and rigidity of the hub and strut system and makes the structure able to support additional loading.

For constructing the strut components used in the geodesic enclosure assembly, it is contemplated that any number of materials can be utilized. Steel, aluminum, other metals, metal alloys, wood, bamboo, composites, polymers, etc. are contemplated for possible building material for the shafts of the struts. Moreover, a combination of these materials may be used when fabricating the shaft component.

The strut-tabs used to connect a strut to a universal hub-tab may be constructed of different materials from the shafts themselves. The strut-tabs for a strut can be constructed of a metal, alloy, composite, wood, bamboo, polymers, or other appropriate materials, whereas the strut itself may also be constructed of the same or different materials described above. Further, the struts and strut-tabs can be formed separately and then combined or they can be formed as a single unit. Although the thicknesses and dimensions of the strut components may differ based on the size and frequency of the dome desired and the load the enclosure is intended to support, the strut-tabs have a universal geometry. Because strut-tabs can be easily attached and secured to the ends of a shaft component, the manufacturing costs can be substantially less than other geodesic enclosure systems in the prior art.

To properly support a geodesic enclosure, the strut-tabs must be secured to the ends of a shaft component. It is contemplated that forming a pair of slot openings on each end of the shaft along a central plane will allow for each slot pair to receive a single strut-tab. The strut-tab is a generally planar component comprising a tab having a port and an alignment notch with a small fillet to guide the strut-tab into the pair of shaft slot openings. The strut-tabs are inserted into the slot openings at the ends of the shaft component. The strut-tabs are then firmly secured to the shaft component using any number of means including welding, adhesives, fasteners, etc. Use of the slot openings is preferable to crimping the ends of a shaft because forming the slot openings does not substantially impact the integrity of the shaft component. Alternatively, a strut-tab can be inserted into an end of a strut without a slot opening and secured therein by welding, adhesives, fasteners, etc. In another embodiment, a strut end can be inserted into a receiving receptacle on a strut-tab, and can be secured therein by welding, adhesive, fasteners, etc.

The strut-tab port and hub-tab port are overlapped and receive one or more fasteners to secure the strut component to a universal hub. To sufficiently secure the components, some means to fasten the strut-tab to the relevant hub-tab should be utilized. The strut-tab port of an assembled strut overlaps the relevant hub-tab port of the universal hub and the two components are secured together via a fastener through the ports. It is contemplated that use of a bolt, rivet, pin or other fastening device could adequately secure a strut-tab to a corresponding hub-tab. In other embodiments, welding, adhesives, etc. may be used in addition to or in place of such fastening devices.

Turning now to the drawings, FIG. 1 illustrates a top plan view of an exemplary embodiment of an unformed pentagonal universal hub 10 wherein the hub 10 is shown with a pentagonal center component 13 having a center port 11. In the embodiment shown in FIG. 1, the center port 11 is approximately round in shape. In other embodiments other shapes are contemplated such as a triangle, quadrilateral, pentagon, polygon, etc. Extending outward from the center component 13 is a plurality of hub-tabs 20, each with a hub-tab port 21 and a radii 22 separating the hub-tabs 20. The number of hub-tabs 20 on a hub 10 corresponds to the number of intended edges along the center component 13 of the hub 10. In another embodiment of the universal hub 10 there may be more hub-tabs 20 on a specific edge than a single hub-tab 20 corresponding to an intended edge. FIG. 1 illustrates the exterior face 15 of the hub 10.

Figure 2:
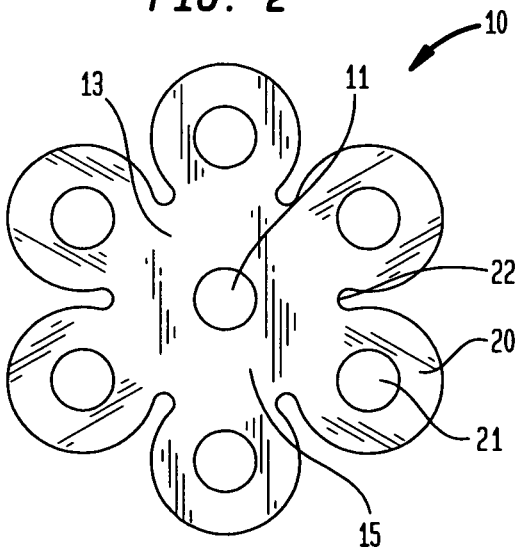
FIG. 2 illustrates a top plan view of an exemplary embodiment of an unformed hexagonal universal hub.

FIG. 2 illustrates a top plan view of an exemplary embodiment of an unformed hexagonal universal hub 10 wherein the hub 10 is shown with a hexagonal center component 13 having a center port 11. Extending outward from the center component 13 is a plurality of hub-tabs 20 with a hub-tab port 21 and a radii 22 separating each of the hub-tabs 20. FIG. 2 illustrates the exterior face 15 of the hub 10.

Figure 3:
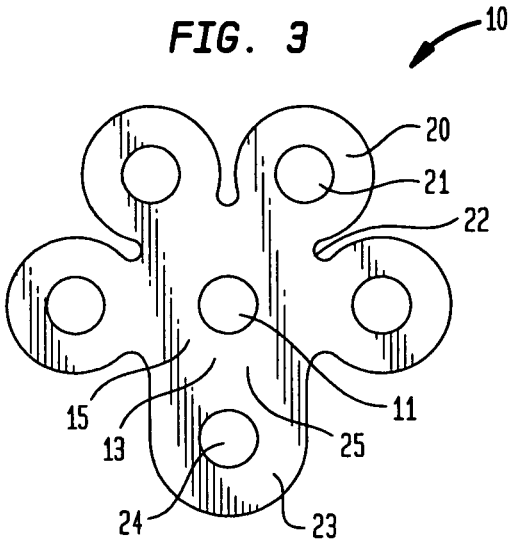
FIG. 3 illustrates a top plan view of an exemplary embodiment of an unformed irregular pentagonal universal hub.

FIG. 3 illustrates a top plan view of an exemplary embodiment of an unformed irregular pentagonal universal hub 10 wherein the hub 10 is shown with an irregular pentagonal center component 13 having a center port 11. Extending outward from the center component 13 is a plurality of hub-tabs 20 with a hub-tab port 21 and a radii 22 separating the hub-tabs. The irregular pentagonal hub in FIG. 3 also includes a specific mounting hub-tab 23 and a mounting tab port 24. FIG. 3 illustrates the exterior face 15 of the hub. It is important to note that in other embodiments, the mounting hub-tab 23 may be reinforced and/or shaped differently in order to bear the extra forces associated with its function.

Figure 4:
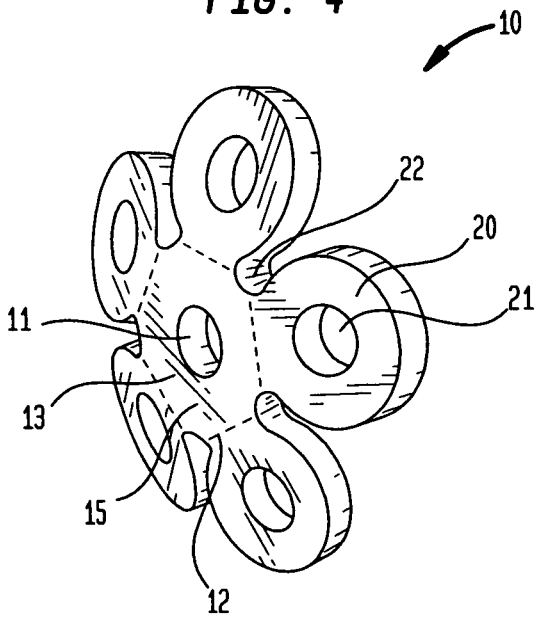
FIG. 4 illustrates a perspective view of an exemplary embodiment of a formed pentagonal universal hub.

FIG. 4 illustrates a perspective view of an exemplary embodiment of a formed pentagonal universal hub 10. The exterior face 15 of the universal hub 10 is shown with a pentagonal center component 13 including a center port 11 in the center. At the sides of the center component 13 are dashed lines that indicate the approximate location of edge lines 12 that may be formed to the angles required by the desired geodesic enclosure frequency. The edge lines 12 also approximate the location of the perimeter which defines the outer edge of the center component 13. At the radii 22, the exterior face 15 meets the interior face 16 (not shown in FIG. 4, see FIG. 7B). The perimeter of the center component occurs where the exterior face 15 and interior face 16 meet at the radii 22 and the edge lines 12 joining the radii 22. The hub-tabs 20 attach to the center component 13 at the perimeter as well. In the embodiment shown in FIG. 4, the hub-tab port 21 is approximately round in shape. In other embodiments other shapes are contemplated such as a triangle, quadrilateral, pentagon, other polygon, etc.

Connected to the edge lines 12 of the pentagonal center component 13 are a plurality of hub-tabs 20, each with a hub-tab port 21 and a radii 22 separating each hub-tab 20. The number of hub-tabs 20 corresponds to the number of edge lines 12 along the center component 13 of the hub.

Figure 5:
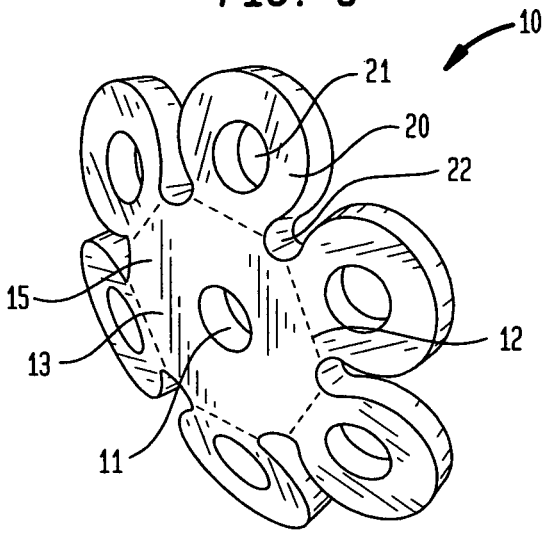
FIG. 5 illustrates a perspective view of an exemplary embodiment of a formed hexagonal universal hub.

FIG. 5 illustrates a perspective view of an exemplary embodiment of a formed hexagonal universal hub 10. The exterior face 15 of the universal hub 10 is shown with the hexagonal center component 13 of the hub including a center port 11 in the center. In other embodiments, the center port 11 can be located differently and can comprise multiple ports as needed. At the sides of the center component 13 are edge lines 12 (again depicted by the dashed lines) that may be formed to the angles required by the desired geodesic enclosure frequency. Connected to the edge lines 12 of the hexagonal center component 13 are a plurality of hub-tabs 20 with a hub-tab port 21, and a radii 22 separating each hub-tab 20. The number of hub-tabs 20 corresponds to the number of edge lines 12 along the center component 13 of the hub. The geometric configuration of the universal hub center component 13 shown in FIG. 5 is a regular hexagon.

Figure 6:
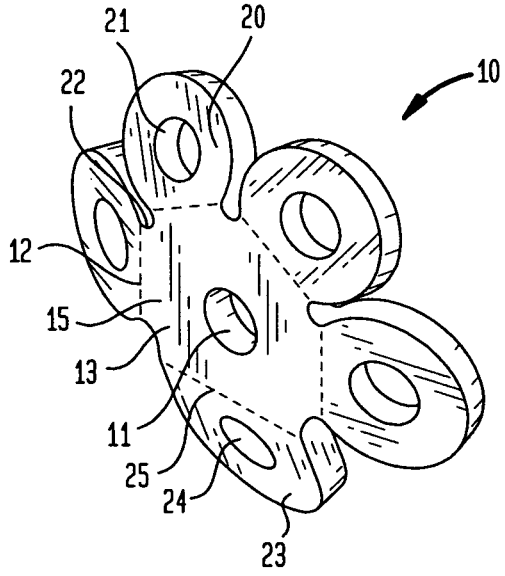
FIG. 6 illustrates a perspective view of an exemplary embodiment of a formed irregular pentagonal universal hub.

FIG. 6 illustrates a perspective view of an exemplary embodiment of a formed irregular pentagonal universal hub 10. The exterior face 15 of the universal hub is shown with the pentagonal center component 13 of the hub including a center port 11 in the center. At the sides of the hub center component 13 are edge lines 12 that can be formed to the angles required by a desired geodesic enclosure frequency and mounting configuration. Connected to the edge lines 12 are several hub-tabs 20 with a hub-tab port 21, and a radii 22 separating each hub-tab 20. The number of hub-tabs 20 corresponds to the number of edge lines 12 along the center component 13 of the hub. The mounting hub-tab 23 may be formed at an angle B (see FIG. 7B), between negative one hundred and eighty degrees and positive one hundred and eighty degrees, inclusive, relative to the plane that lies on the exterior face 15 of the hub center component and may be different than angle A (see FIG. 7A), or any other hub-tab angle.

Figure 9A:
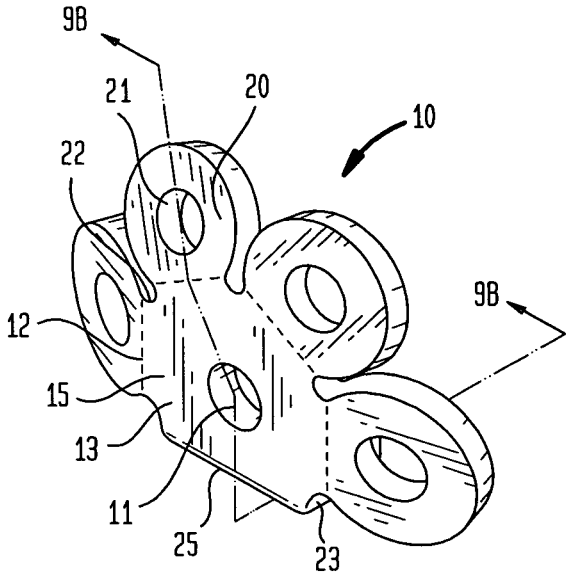
FIG. 9A illustrates a perspective view of an exemplary embodiment of a formed irregular pentagonal universal hub.

FIG. 6 also illustrates an angle strip 25 which is a special edge line 12 that represents the approximate location for a mounting hub-tab angle to be formed (for an example with a formed angle, see FIG. 9A, angle strip 25). The mounting hub-tab 23 also includes a mounting hub-tab port 24. The geometric configuration of the hub center component 13 shown in FIG. 6 is an irregular pentagon.

Figure 7A:
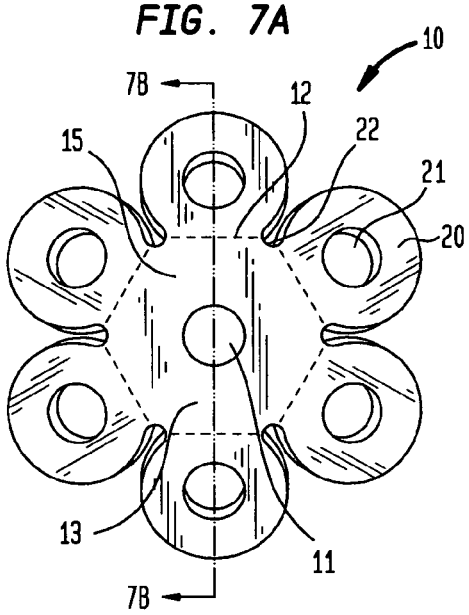
FIG. 7A illustrates a top plan view of an exemplary embodiment of a formed hexagonal universal hub.
Figure 7B:
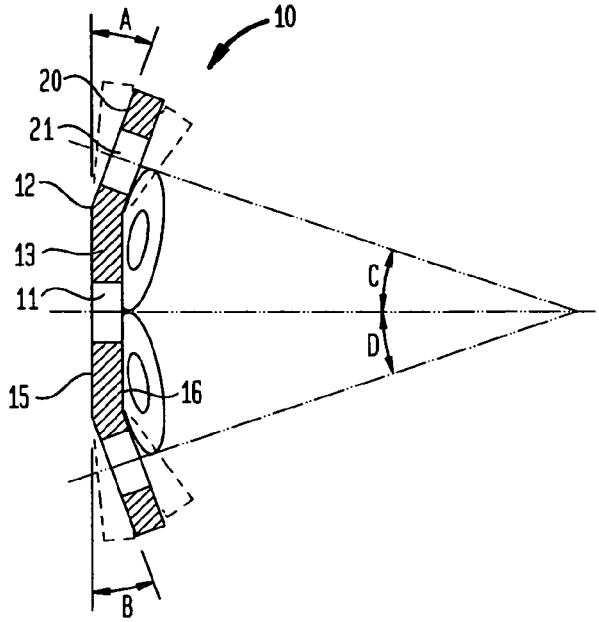
FIG. 7B illustrates a sectional profile view of an exemplary embodiment of a formed hexagonal universal hub.

FIG. 7A illustrates a top plan view of an exemplary embodiment of a formed hexagonal universal hub 10, while FIG. 7B illustrates a sectional profile view of an exemplary embodiment of a formed hexagonal universal hub 10. The line drawn along a central plane of FIG. 7A represents the line used to clarify the subsequent sectional view of the invention in FIG. 7B. In FIG. 7B, angles A and B are the angles between the plane that lies on the exterior face 15 of the hub center component 13 and the plane that lies on the exterior face of the corresponding hub-tab 20. Angles C and D shown in the FIG. represent the angles formed between the central axis of the hub center port 11 and the axis of the corresponding hub-tab port 21. Angles C and D will vary based on the values of angles A and B, respectively.

The exterior face 15 of the hub is shown in FIG. 7A. In FIG. 7B the sectional view center is the universal hub center port 11 within the universal hub center component 13. The formed polygonal universal hub has one or more edge lines 12 which are located between the hub-tab 20 and the center component of the hub 13. Also shown is how the hub-tab 20 is angled between zero degrees and approximately ninety degrees from a plane lying on the exterior face 15 of the center component. The radii 22 between the hub-tabs 20 reduces stress concentrations. FIG. 7B also shows both the exterior face 15 and the interior face 16 of the universal hub 10 with the hub-tab 20 angled toward the interior face 16.

Figure 8A:
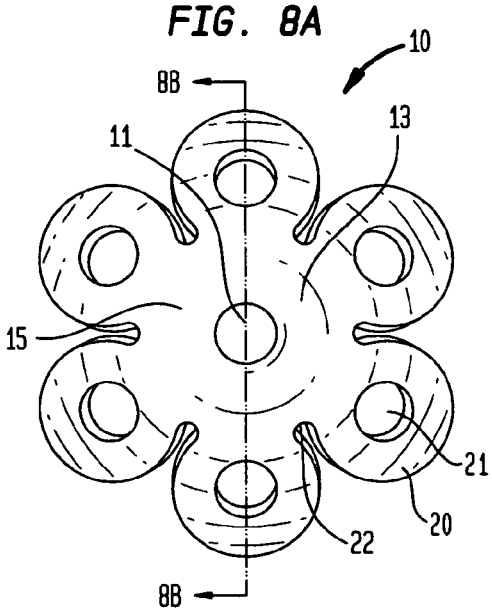
FIG. 8A illustrates a top plan view of an exemplary embodiment of a formed semi-spherical universal hub.
Figure 8B:
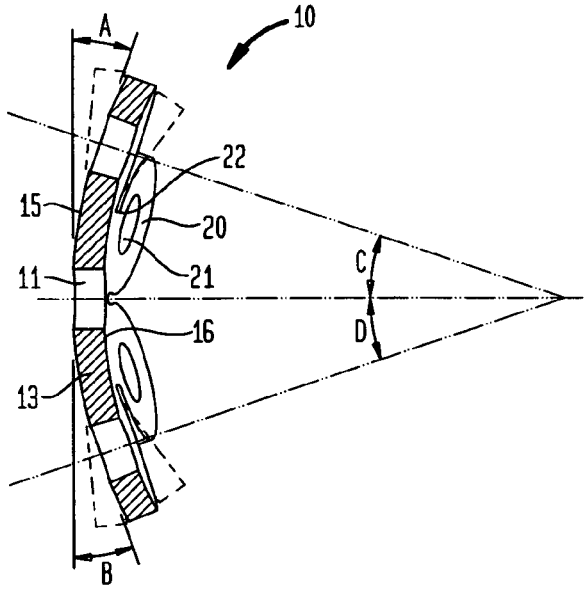
FIG. 8B illustrates a sectional profile view of an exemplary embodiment of a formed semi-spherical universal hub.

FIG. 8A illustrates a top plan view of an exemplary embodiment of a formed semi-spherical universal hub 10, while FIG. 8B illustrates a sectional profile view of an exemplary embodiment of a formed semi-spherical universal hub 10. The line drawn along a central plane of FIG. 8A represents the line used to clarify the subsequent sectional view of the invention in FIG. 8B. In FIG. 8B, angles A and B are the angles between the plane that is normal to the hub center port 11 central axis at the exterior face 15 and the plane that is normal to the corresponding hub-tab port 21 axis at the exterior face 15. Angles C and D shown in the Figure represent the angles formed between the axis of the hub center port 11 and the axis of the corresponding hub-tab port 21. Angles C and D will vary based on the values of angles A and B, respectively. The exterior face 15 of the hub is shown in FIG. 8A. In FIG. 8B the sectional view center is the universal hub center port 11 with a formed contour along the hub profile 13. Also shown is how the hub-tab center port 21 is also angled between zero degrees and approximately ninety degrees. The radii 22 between the hub-tabs 20 reduce stress concentrations. FIG. 8B also shows both the exterior face 15 and the interior face 16 of the universal hub 10 with the hub-tab 20 curved toward the interior face 16.

Figure 9B:
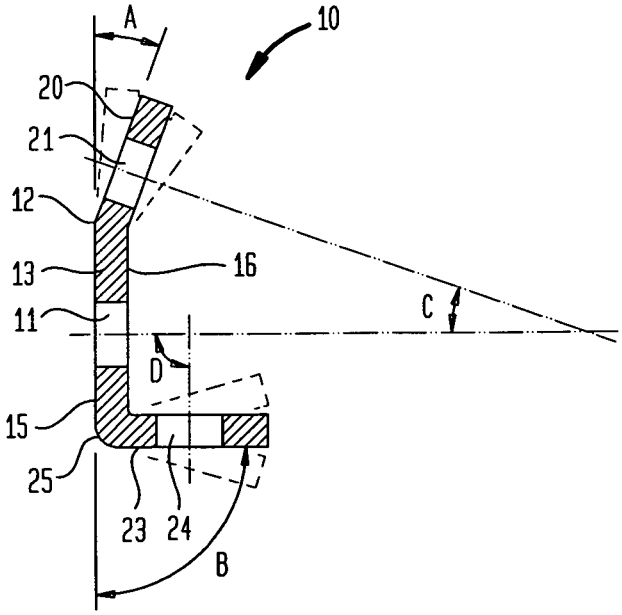
FIG. 9B illustrates a sectional profile view of an exemplary embodiment of a formed irregular pentagonal universal hub.

FIG. 9A illustrates a perspective view of an exemplary embodiment of a formed irregular pentagonal universal hub 10; while FIG. 9B illustrates a sectional profile view of an exemplary embodiment of a formed irregular pentagonal universal hub 10. The line drawn along a central plane of FIG. 9A represents the line used to clarify the subsequent sectional view of the invention in FIG. 9B. In FIG. 9B, angles A and B are the angles between the plane that lies on the exterior face 15 of the hub center component 13 and the plane that lies on the exterior face 15 of the corresponding hub-tab 20. Angles C and D shown in the FIG. represent the angles formed between the axis of the hub center port 11 and the axis of the corresponding hub-tab port 21. Angles C and D will vary based on the values of angles A and B, respectively. The exterior face 15 of the hub 10 is shown in FIG. 9A. In FIG. 9B the sectional view center is the polygonal hub center port 11 within the hub center component 13. The formed irregular polygonal universal hub 10 has one or more edge lines 12, which are located between the hub-tab 20 and the center component 13 of the hub 10. Also shown in FIG. 9B is the mounting hub-tab 23 comprising an additional mounting hub port 24 and fillet 25 formed at angle B, between negative one hundred and eighty degrees and positive one hundred and eighty degrees relative to the plane that lies on the exterior face 13 of the hub center component and may be different than angle A, or any other hub-tab angle. The radii 22 between the hub-tabs 20 reduce stress concentrations. FIG. 9B also shows both the exterior face 15 and the interior face 16 of the irregular pentagonal universal hub with the hub-tab 20 and the mounting hub-tab 23 angled toward the interior face 16.

Figure 10:
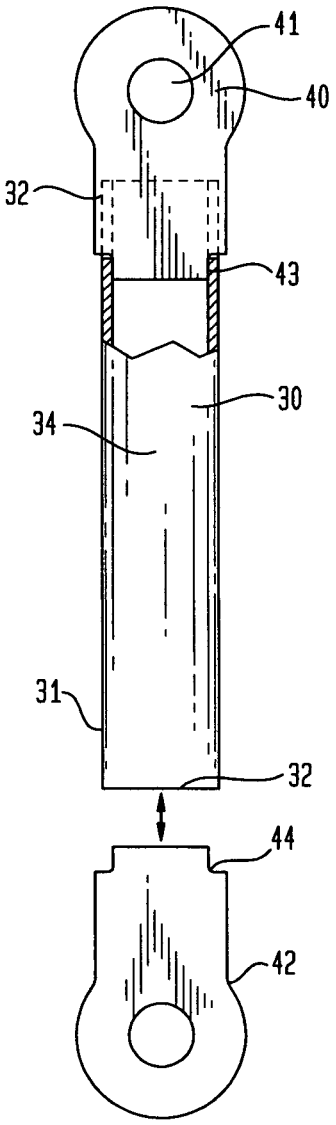
FIG. 10 illustrates a sectional top plan view of an exemplary embodiment of a strut assembly comprising two strut-tabs connected by a shaft.

FIG. 10 illustrates a sectional top plan view of an exemplary embodiment of a strut assembly comprising two strut-tabs connected by a shaft. The strut component 30 comprises two strut tabs 40 and a center shaft 34. The strut component 30 has ends 32 with slot openings 31, and strut-tabs 40 connected to the shaft 34 via a plurality of slot openings 31. Each strut-tab 40 comprises a generally planar tab having a strut-tab port 41 that can overlap a corresponding hub-tab port and be secured thereto. Although in the embodiment shown in FIG. 10 only a single strut-tab port 41 is shown per strut-tab, it is contemplated in other embodiments that the number, size, and location of strut-tab ports can vary. An alignment notch 43 is located on each side of one end of the strut-tab 40. The plurality of notches 43 defines a fillet 44 for alignment and guidance of the strut-tab 40 into the ends 32. Moreover, the slot openings 31 are cut along a central plane through both ends 32 of the shaft 34 to provide a mounting location for the strut-tabs 40. In other embodiments, there can be a single alignment notch 43 and a single slot opening 31.

In another embodiment, the center shaft 34, the first strut end 32 and the second strut end 32 of the strut 30 can be formed as a single component. Likewise, in yet another embodiment, the strut-tabs 40 can also be formed along with the other strut components to make a single strut 30.

Figure 11:
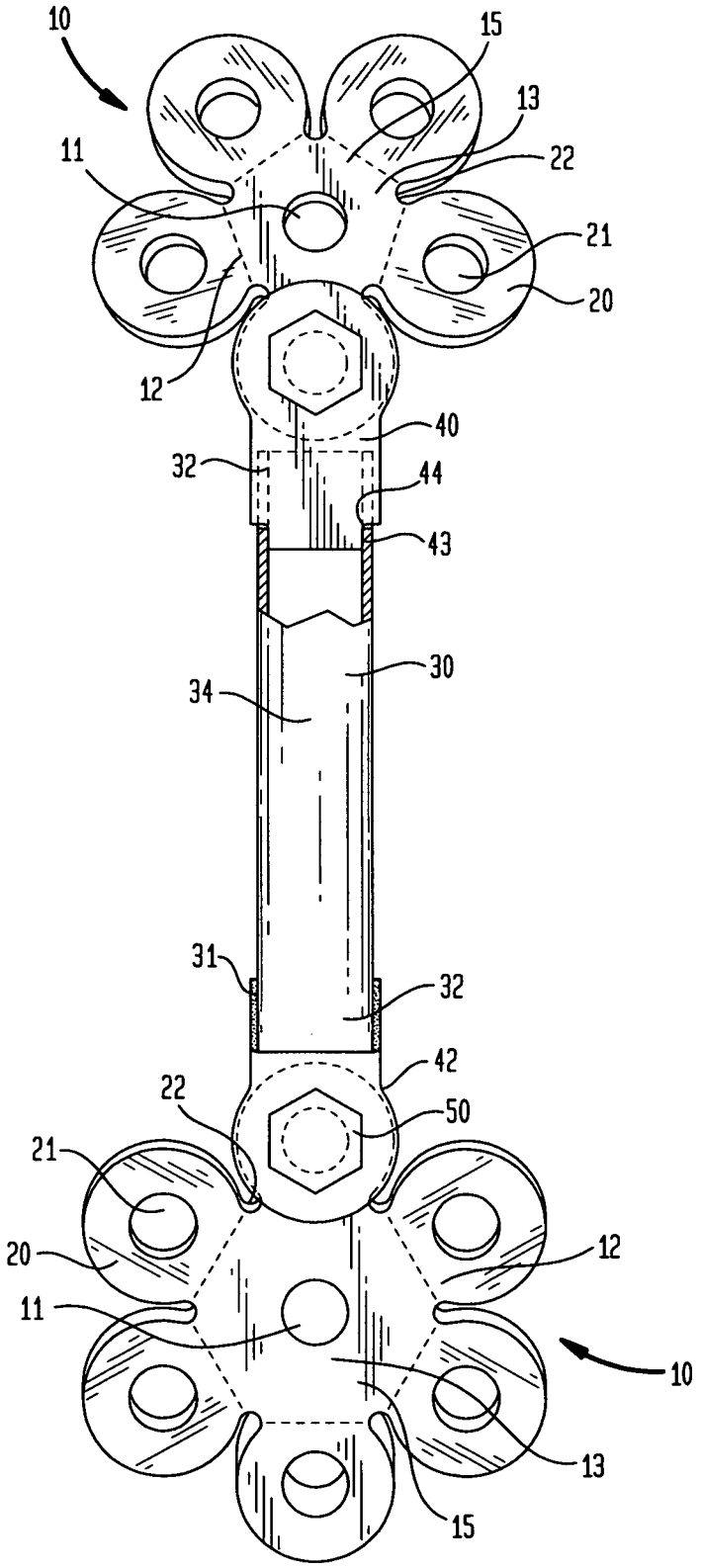
FIG. 11 illustrates a sectional top plan view of an exemplary embodiment of two universal hubs connected by a strut.

FIG. 11 illustrates a sectional top plan view of an exemplary embodiment of two universal hubs 10 connected by a strut 30. Visible in the Figure for both hubs 10 are the exterior faces 15. Specifically, the strut-tab 40 and the strut-tab port overlap the hub-tab 20 and the hub-tab port. The strut component 30 is comprised of a shaft 34, ends 32 with slot openings 31, and strut-tabs 40 connected to the shaft 34 via the slot openings 31 using a notch 43 and fillet 44 for alignment to provide a mounting location for the strut-tabs (40). Moreover, the slot openings 31 are cut along a central plane through the ends 32 of the shaft 34. In this embodiment, the tab attachment means 50 comprises a bolt that secures the strut-tab 40 via the strut-tab port 41 to the hub-tab 20 via the hub-tab port 21. In other embodiments, the attachment means for securing the strut-tab 40 to the hub-tab 20 can be selected from: a rivet system, nuts, washers, bolts, screws, pins, other mechanical fasteners and adhesives.

Figure 12:
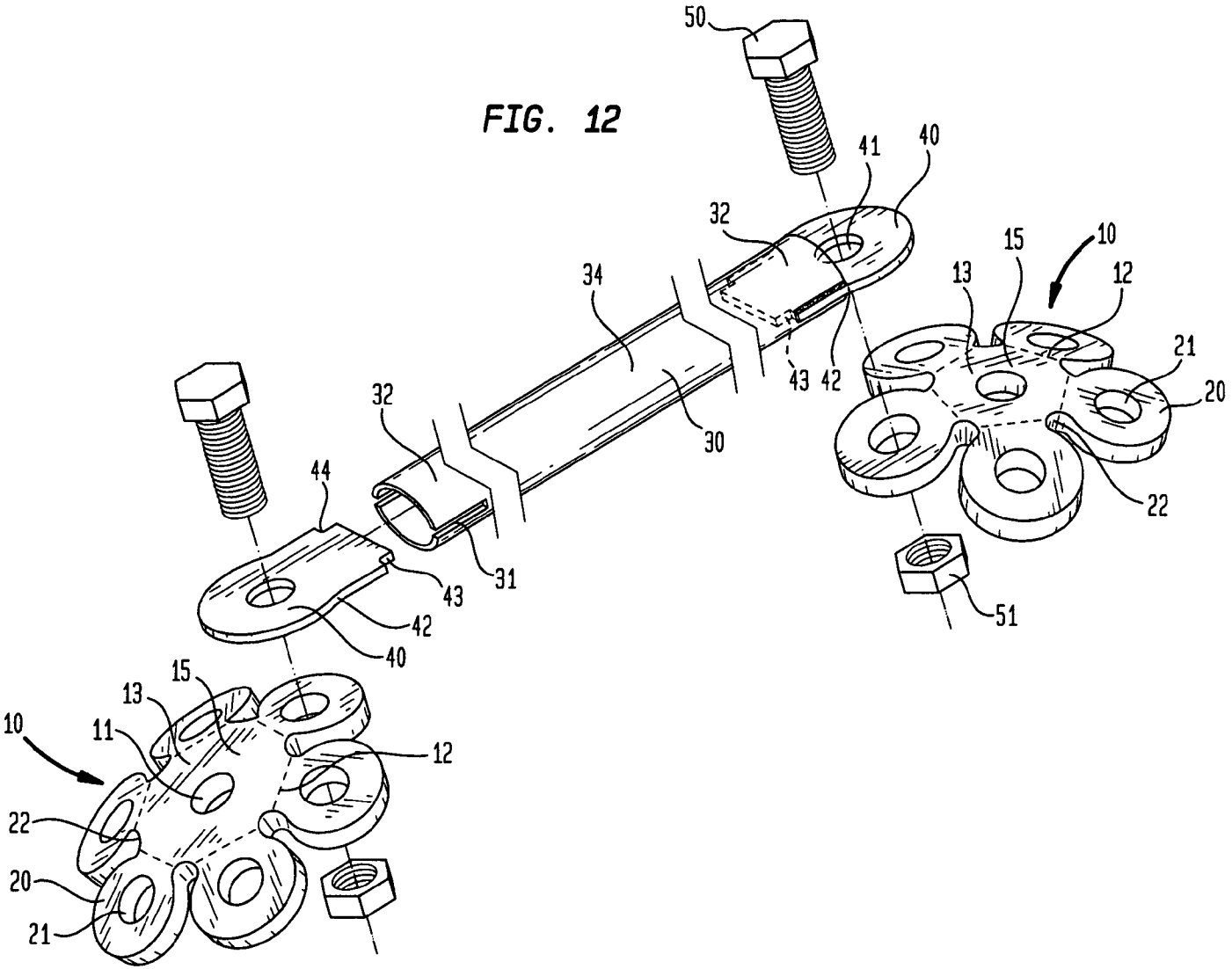
FIG. 12 illustrates an exploded perspective view of an exemplary embodiment of two universal hubs connected by a strut.

FIG. 12 illustrates an exploded perspective view of an exemplary embodiment of two universal hubs connected by a strut. The FIG. shows a hexagonal hub connected to a pentagonal hub via a strut component 30. The hubs are secured to the strut via a tab attachment means 50 and 51 which comprises a nut and bolt assembly.

Visible in the diagram is the exterior face 15 of each universal hub 10. Specifically, the strut-tab 40 and the strut-tab port 41 overlap the hub-tab port 21 of the hub-tab 20 that is attached to the hub center component 13. The strut component 30 is comprised of a shaft 34, ends 32, and strut-tabs 40 connected at the ends 32 of the strut 30 through small slot openings 31 designed to receive a strut-tab 40. Moreover, the slot openings 31 are cut longitudinally at one hundred and eighty degrees at the ends 32 of the shaft 40 and connect to the shaft 40 via a notch 43 with a small fillet 44 along the strut-tab waist 42 at the connecting end of the strut-tab 40. It should be noted that the strut-tabs 40 can be placed on top of the exterior face 15 of the hub-tabs 20 or they can be placed on the interior face 16 of the hub-tabs 20.

Figure 13A:
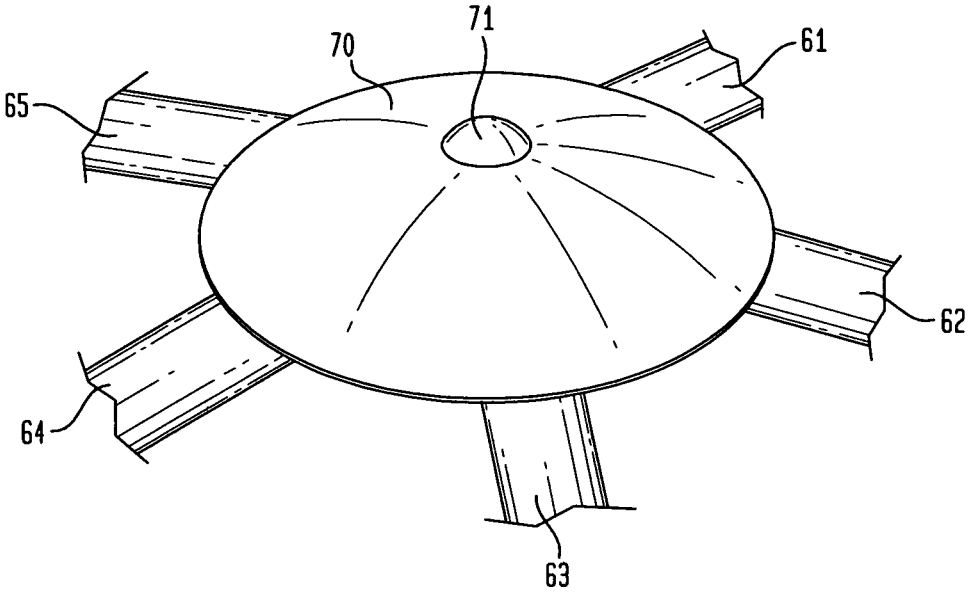
FIG. 13A illustrates a perspective view of an exemplary embodiment of a universal hub connected to a plurality of struts with a hub cap located on the top of the hub.

FIG. 13A illustrates a perspective view of an exemplary embodiment of a universal hub connected to a plurality of struts with a hub cap located on the top of the hub. In the embodiment in FIG. 13A, the hub cap 70 is generally spherical in shape and is designed to cover the hub, hub tabs, strut-tabs, etc. In other embodiments, the hub cap can be non-spherical. It is often necessary to protect these important components as well as to cover any sharp points or protrusions thereon so that an internal cover and/or external cover can be easily added to the resulting structure without fear of damage to or from the hub components. It is preferred to attach the hub cap 70 to the hub with a hub cap fastener 71 that is smooth and rounded as well (such as a carriage bolt, for example) so as to further minimize the existence of sharp protrusions. Other hub cap fasteners are contemplated. As the hub cap 70 is designed to cover and protect the hub and associated attachments, said components are not visible in FIG. 13A, see FIG. 13B instead. Five struts 61, 62, 63, 64 and 65 can be seen extending outwards from underneath the hub cap 70. In other embodiments, the number of struts attached to a hub can be one, two, three, or more.

Figure 13B:
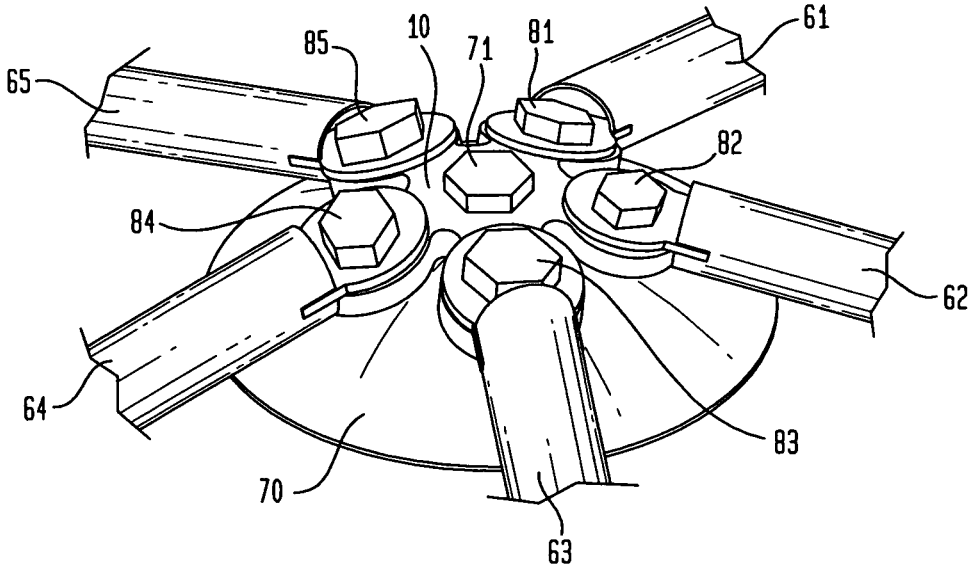
FIG. 13B illustrates a perspective view of an exemplary embodiment of a universal hub connected to a plurality of struts with a hub cap located on the bottom of the hub.

FIG. 13B illustrates a perspective view of an exemplary embodiment of a universal hub connected to a plurality of struts with a hub cap located on the bottom of the hub. The hub cap 70 is generally spherical in shape and is designed to cover the hub 10, hub tabs, strut-tabs, etc. It is often necessary to protect these important components as well as to cover any sharp points or protrusions thereon so that an internal cover and/or external cover can be easily added to the resulting structure without fear of damage to or from the hub components. As can be seen in FIG. 13B, tab attachment means 81, 82, 83, 84 and 85 can have protrusions and the ends of the struts can also have burrs, nicks, etc. that might otherwise damage a cover if not for a hub cap 70. In FIG. 13B, an exemplary embodiment of a hub cap fastener 71 comprises a bolt and nut or other locking device to ensure the bolt stays attached to the hub 10 and hub cap 70. Five struts 61, 62, 63, 64 and 65 can be seen extending outwards from the hub 10. In other embodiments, the number of struts attached to a hub can be one, two, three, or more.

Figure 14A:
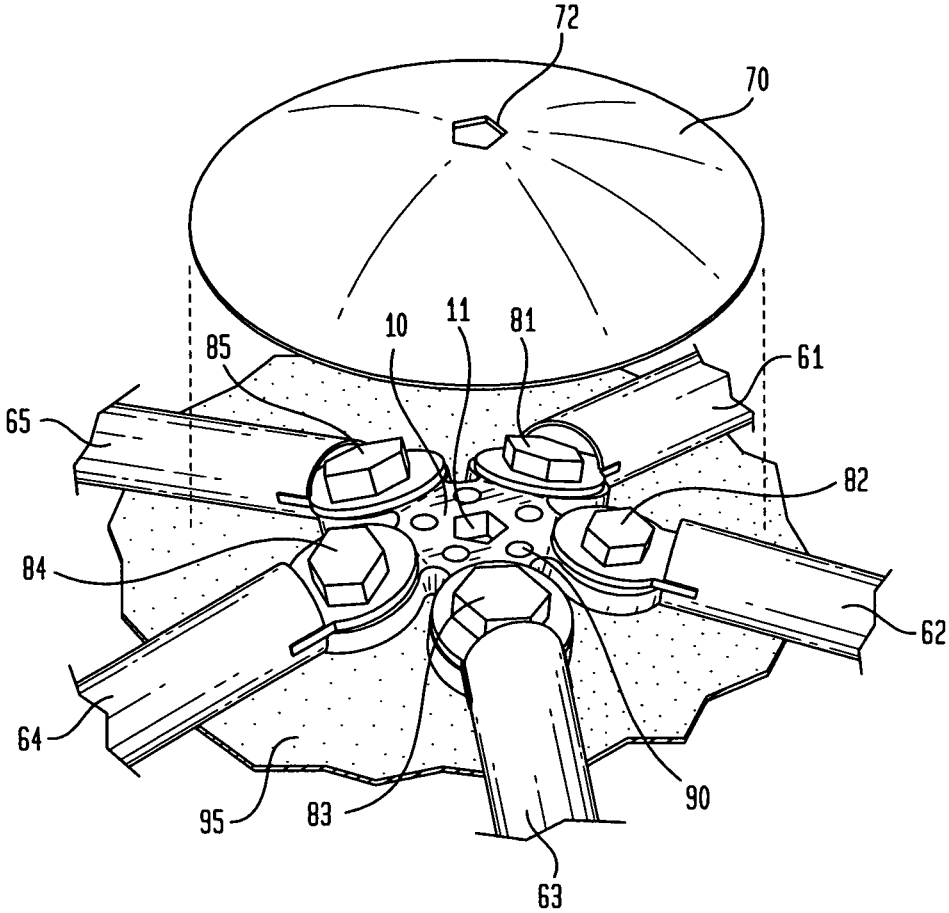
FIG. 14A illustrates an exploded perspective view of an exemplary embodiment of a universal hub connected to a plurality of struts with a hub cap and an internal covering.

FIG. 14A illustrates an exploded perspective view of an exemplary embodiment of a universal hub 10 connected to a plurality of struts 61, 62, 63, 64 and 65 with a hub cap 70 and an internal covering 95. The struts 61-65 are secured to the hub 10 using tab attachment means 81, 82, 83, 84 and 85 which comprise a bolt and nut assembly—other types of tab attachment means 81-85 are contemplated in other embodiments.

The center port 11 of the hub 10 and the hub cap port 72 are polygonal in shape in FIG. 14A. It is important to note that the center port 11 and hub cap port 72 can be circular or annular, or they can be polygonal as shown here. In other embodiments, other shapes are contemplated for the center port 11 and hub cap port 72. The use of a non-circular port shape can help the associated hub cap fastener (not shown here, see FIGS. 13A and B item 71) secure the hub cap 70 to the hub 10.

Also shown in FIG. 14A are a plurality of sub-ports 90 on the hub 10. These sub-ports 90 can be used to assist in securing the hub cap 70, the cover 95 and/or other objects to the universal hub 10. The numbers, sizes and locations of these sub-ports 90 can vary without departing from the scope of the invention. In FIG. 14A, the cover 95 is shown as being located on the interior of the hub 10 assembly. In other embodiments, a cover 95 can be located on the exterior of the hub 10 or on both the exterior and interior.

Figure 14B:
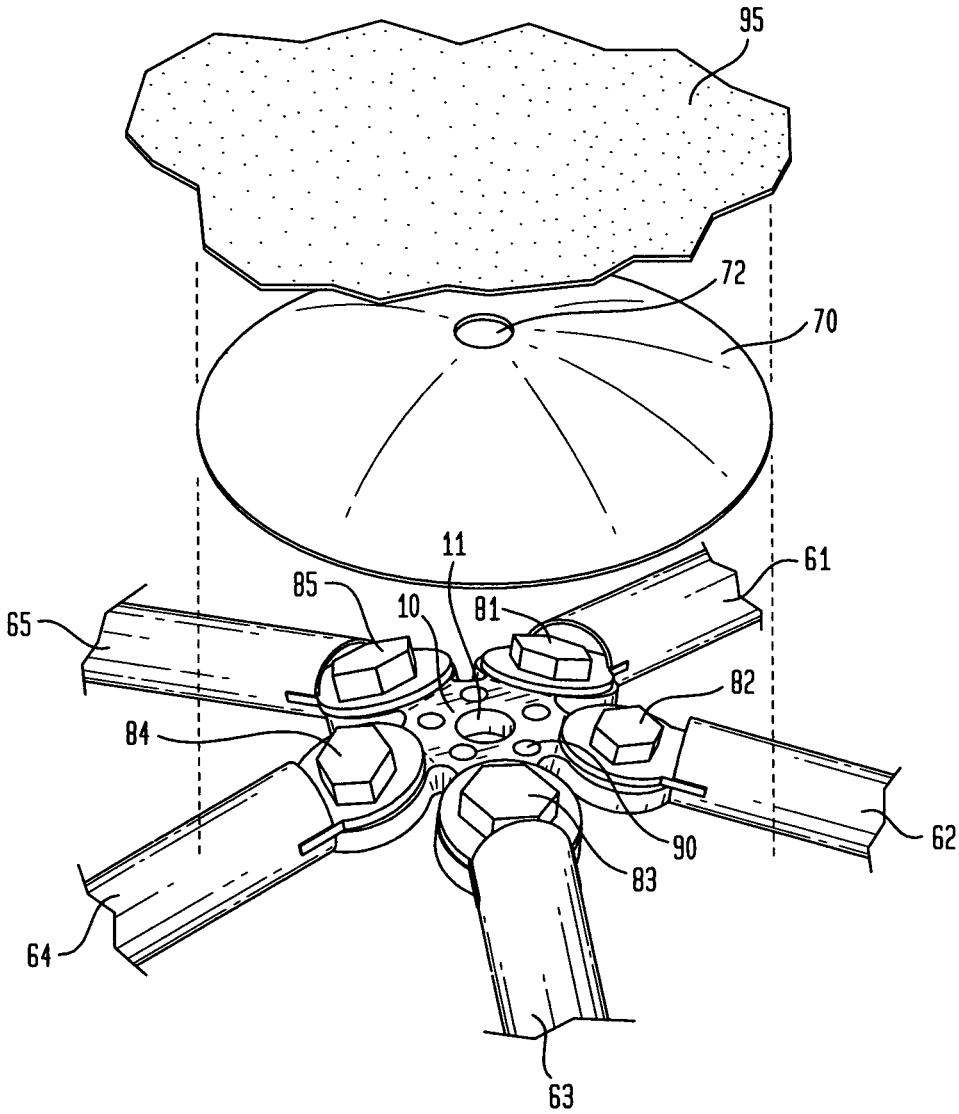
FIG. 14B illustrates an exploded perspective view of an exemplary embodiment of a universal hub connected to a plurality of struts with a hub cap and an external covering.

FIG. 14B illustrates an exploded perspective view of an exemplary embodiment of a universal hub 10 connected to a plurality of struts 61-65 via a plurality of tab attachment means 81-85 with a hub cap 70 and an external covering 95. The struts 61-65 are secured to the hub 10 using tab attachment means 81, 82, 83, 84 and 85 which comprise a bolt and nut assembly—other types of tab attachment means 81-85 are contemplated in other embodiments.

The center port 11 of the hub 10 and the hub cap port 72 are circular or annular in shape in FIG. 14B. It is important to note that in other embodiments, other shapes are contemplated for the center port 11 and hub cap port 72. The use of a non-circular port shape can help the associated hub cap fastener (not shown here, see FIGS. 13A and B item 71) secure the hub cap 70 to the hub 10.

Also shown in FIG. 14B are a plurality of sub-ports 90 on the hub 10. These sub-ports 90 can be used to assist in securing the hub cap 70, the cover 95 and/or other objects to the universal hub 10. The numbers, sizes and locations of these sub-ports 90 can vary without departing from the scope of the invention. In FIG. 14B, the cover 95 is shown as being located on the exterior of the hub 10 assembly. In other embodiments, a cover 95 can be located on the interior of the hub 10 or on both the exterior and interior. Furthermore, the hub cap 70 can be located between the cover 95 and the hub 10, the cover 95 can be between the hub cap 70 and the hub 10, and/or the hub cap 70 can be removed and the cover 95 can be in contact with the hub 10.

While particular embodiments of the invention have been described and disclosed in the present application, it is clear that any number of permutations, modifications, or embodiments may be made without departing from the spirit and the scope of this invention. Accordingly, it is not the inventor's intention to limit this invention in this application, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise embodiment or form disclosed herein or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying or subsequent filing papers, are incorporated herein by reference. Aspects of the invention can be modified, if necessary, to employ the systems, functions, and concepts of the various references described above to provide yet further embodiments of the invention.

In light of the above "Detailed Description," the Inventor may make changes to the invention. While the detailed description outlines possible embodiments of the invention and discloses the best mode contemplated, no matter how detailed the above appears in text, the invention may be practiced in a myriad of ways. Thus, implementation details may vary considerably while still being encompassed by the spirit of the invention as disclosed by the inventor. As discussed herein, specific terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

The above specification, examples and data provide a description of the structure and use of exemplary implementations of the described articles of manufacture and methods. It is important to note that many implementations can be made without departing from the spirit and scope of the invention.

What is claimed is:

1. A universal hub and strut system for assembling a geodesic enclosure, the universal hub and strut system comprising:

a universal hub having a center component with an exterior face, an interior face, a perimeter joining the exterior face to the interior face at a plurality of radii, a center port, and a central axis extending through the center port and perpendicular to the exterior face;

a strut having a first strut end, a second strut end, and a center shaft extending between the first strut end and the second strut end;

a first strut-tab and a second strut-tab, wherein the first strut-tab comprises a generally planar first member extending longitudinally from a first tab end to a second tab end and having a first strut-tab port extending generally perpendicular to a longitudinal axis of the first member and completely through the first member near the first tab end of the first member, and a first alignment notch having a generally rectangular shape and comprising at least one notch in proximity to the second tab end, and the second strut-tab comprises a generally planar second member extending longitudinally from a third tab end to a fourth tab end and having a second strut-tab port extending generally perpendicular to a longitudinal axis of the second member extending completely through the second member near the third tab end of the second member, and a second alignment notch having a generally rectangular shape and comprising at least one notch in proximity to the fourth tab end;

wherein the first strut-tab attaches to the first strut end by aligning the first alignment notch within a first slot opening in the first strut end and inserting the first strut-tab into the first strut end, and the second strut-tab attaches to the second strut end by aligning the second alignment notch within a second slot opening in the second strut end and inserting the second strut-tab into the second strut end;

a hub-tab affixed along the perimeter of the center component, the hub-tab arrayed at an angle in relation to a plane through the hub and perpendicular to the central axis of the center component, the hub-tab having a hub-tab exterior face that extends from the exterior face of the universal hub, the hub-tab exterior face abutting the exterior face of the universal hub along the perimeter of the universal hub, and wherein the hub-tab has a first hub-tab port extending completely through the hub-tab, and a first hub-tab port axis extending through a center of the first hub-tab port and perpendicular to the hub-tab exterior face;

the first strut-tab port overlapping the first hub-tab port and securing the first strut-tab to the first hub-tab via a tab attachment means;

the first hub-tab port axis crossing the central axis; and a plurality of hub caps that attach to the universal hub and strut assembly, wherein the plurality of hub caps comprise each a disc-shaped spherical portion that extends to cover the center component, the hub tab, the first strut-tab, and the first strut end.

2. The universal hub and strut system of claim 1, wherein the center component is a generally flat polygonal shape.

3. The universal hub and strut system of claim 1, wherein the center component is a generally curved spherical shape.

4. The universal hub and strut system of claim 1, wherein the center shaft, the first strut end, and the second strut end are formed together as a single component.

5. The universal hub and strut system of claim 1, wherein the center port is generally polygonal in shape.

6. The universal hub and strut system of claim 1, wherein the center port is generally circular in shape.

7. The universal hub and strut system of claim 1, wherein the hub-tab port is generally polygonal in shape.

8. The universal hub and strut system of claim 1, wherein the hub-tab port is generally circular in shape.

9. The universal hub and strut system of claim 1, wherein the first strut-tab port is generally polygonal in shape.

10. The universal hub and strut system of claim 1, wherein the first strut-tab port is generally circular in shape.

11. The universal hub and strut system of claim 1, wherein the tab attachment means used to secure the first strut-tab to the hub-tab is selected from the group consisting of a rivet system, nuts, washers, bolts, screws, pins, other mechanical fasteners and adhesives.

12. The universal hub and strut system of claim 1, wherein the center component further comprises a plurality of sub-ports.

13. The universal hub and strut system of claim 1, wherein the angle is between and including negative one hundred and eighty degrees and one hundred and eighty degrees.

14. A universal hub and strut system for assembling a geodesic enclosure, the universal hub and strut system comprising:

a universal hub having a center component with an exterior face, an interior face, a perimeter joining the exterior face to the interior face at a plurality of radii, a center port, and a central axis extending through the center port and perpendicular to the exterior face;

a strut having a first strut end, a second strut end, and a center shaft extending between the first strut end and the second strut end;

a first strut-tab and a second strut-tab, wherein the first strut-tab comprises a generally planar first member extending longitudinally from a first tab end to a second tab end and having a first strut-tab port extending generally perpendicular to a longitudinal axis of the first member and completely through the first member near the first tab end of the first member, and a first alignment notch having a generally rectangular shape and comprising at least one notch in proximity to the second tab end, and the second strut-tab comprises a generally planar second member extending longitudinally from a third tab end to a fourth tab end and having a second strut-tab port extending generally perpendicular to a longitudinal axis of the second member extending completely through the second member near the third tab end of the second member, and a second alignment notch having a generally rectangular shape and comprising at least one notch in proximity to the fourth tab end;

wherein the first strut-tab attaches to the first strut end by aligning the first alignment notch within a first slot opening in the first strut end and inserting the first strut-tab into the first strut end, and the second strut-tab attaches to the second strut end by aligning the second alignment notch within a second slot opening in the second strut end and inserting the second strut-tab into the second strut end;

a hub-tab affixed along the perimeter of the center component and the hub-tab and exterior face of the universal hub being adapted to form a portion of a generally spherical shape, the hub-tab having a hub-tab exterior face that extends from the exterior face of the universal hub, the hub-tab exterior face abutting the exterior face of the universal hub along the perimeter of the universal hub, and wherein the hub-tab has a first hub-tab port extending completely through the hub-tab, and a first hub-tab port axis extending through a center of the first hub-tab port and perpendicular to the hub-tab exterior face;

the first strut-tab port overlapping the first hub-tab port and securing the first strut-tab to the first hub-tab via a tab attachment means;

the first hub-tab port axis crossing the central axis; and a plurality of hub caps that attach to the universal hub and strut assembly, wherein the plurality of hub caps comprise each a disc-shaped spherical portion that extends to cover the center component, the hub tab, the first strut-tab, and the first strut end.

* * * * *